United States Patent [19]

Huber et al.

[11] Patent Number: 5,036,242

[45] Date of Patent: Jul. 30, 1991

[54] LAMP COOLING SYSTEM

[75] Inventors: James V. Huber, Oak Park; Bhakti S. Patel, Bensenville; Jacob Tikhtman, Lincolnwood, all of Ill.

[73] Assignee: Atlas Electric Devices Company, Chicago, Ill.

[21] Appl. No.: 424,111

[22] Filed: Oct. 19, 1989

[51] Int. Cl.[5] ..... H01J 7/26

[52] U.S. Cl. ..... 313/35; 313/12; 165/104.33; 165/108

[58] Field of Search ..... 313/12, 22, 35, 643; 165/60, 104.33, 108

[56] References Cited

U.S. PATENT DOCUMENTS 3,447,013 5/1969 Van Ornum et al. ..... 313/12

FOREIGN PATENT DOCUMENTS 79663 5/1985 Japan ..... 313/22

*Primary Examiner*—Donald J. Yusko
*Assistant Examiner*—Michael Horabik
*Attorney, Agent, or Firm*—Gerstman & Ellis Ltd.

[57] ABSTRACT

A lamp cooling system is provided in which a liquid-cooled lamp is connected to a flow circuit conduit for cooling liquid circulating through the lamp. A liquid-/air heat exchanger is positioned in the flow circuit conduit to cool liquid flowing in the flow circuit conduit by heat exchange with air.

13 Claims, 1 Drawing Sheet

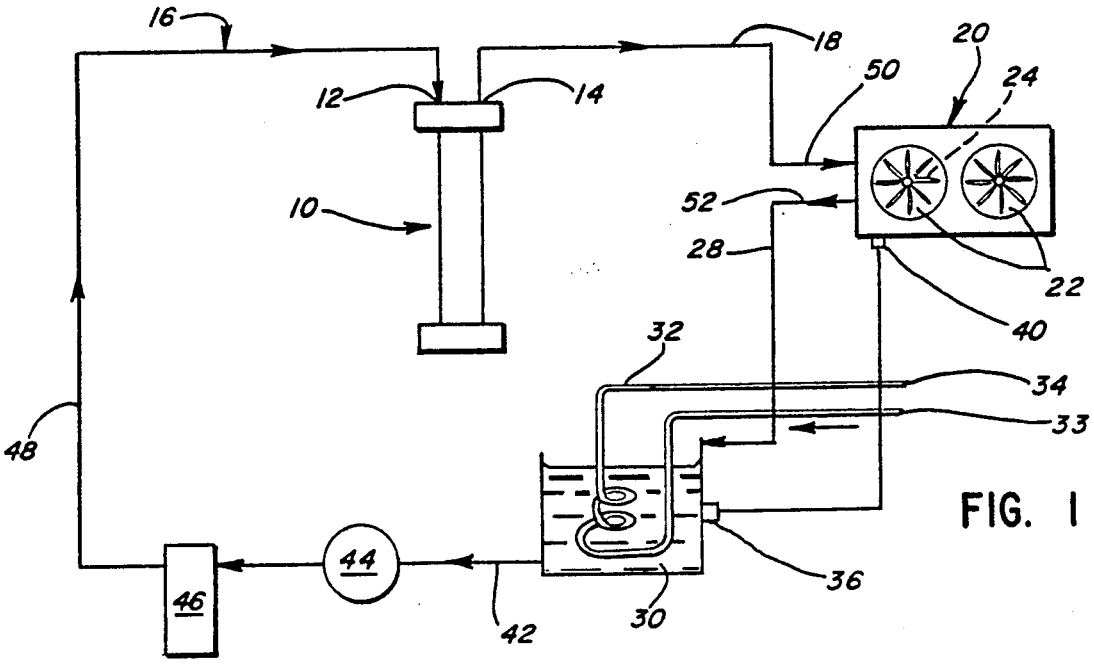
FIG. 1
FIG. 2
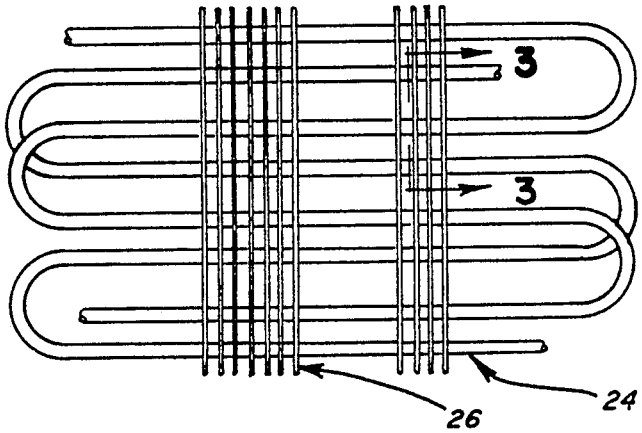
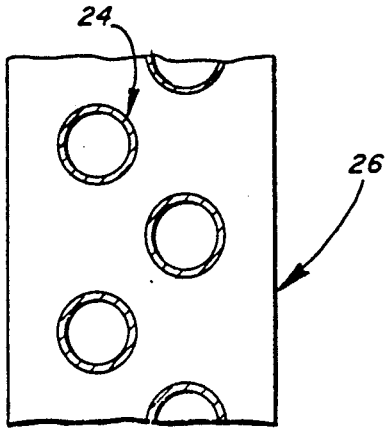
FIG. 3

LAMP COOLING SYSTEM

BACKGROUND OF THE INVENTION

"Xenon burners" are actually lamps rather than devices which cause combustion, which lamps operate at very high temperatures and with great radiation intensity so that they appear to involve a combustion process, although the device is simply a high intensity lamp. These xenon lamps are used as a source of high intensity radiation and heat in various devices, particularly apparatus for the accelerated age testing of materials such as fabrics, plastics, and paint films, to determine their useful life under outdoor or other conditions where high temperatures and ultra violet radiation are present. Examples of such testing apparatus are the commercial materials testings systems available from Atlas Electric Devices Co. of Chicago, Ill.

Such high intensity xenon "burner" lamps emit so much energy that they generally include a water cooling system, to avoid melting of the quartz bulb and destruction of other components of the lamp during operation. In the prior art, a closed-loop conduit is provided for circulating water through the xenon lamp, with the circulating water passing through a water reservoir where there are tap water heat exchange coils to provide water/water heat exchange between the circulating water in the reservoir and cold, circulating tap water passing through the coiled tubing in the reservoir. By this means, heat from the xenon lamp may be first transferred to the circulating water, and then removed from the water by heat exchange with flowing tap water in the coiled tubing, prior to recirculating the water to pick up another load of heat from the xenon lamp.

Additionally, a deionizing unit is also provided in the water circulation path, to avoid the deposition of solutes from the water onto water-contacting surfaces of the xenon lamp. Such deposits are undesirable because they reduce the radiation emission characteristics of the xenon lamp, and increase its heat of operation.

Such a prior art cooling system has the disadvantage that it is of course dependent upon an external water source. A xenon lamp can have a power of typically 2800 to 8400 watts, so that a relatively large amount of cooling tap water must pass through the system. Thus, such a system is not desirable for use in areas where there is a water shortage, or where the water pressure is low, or where the water is not cold enough for effective heat exchange. Also, upon the failure of the water supply, the apparatus may not be able to operate, or it may be damaged before it is realized that the water flow has failed.

As another issue, any leak in the heat exchange barrier between the cooling tap water and the recirculating heat exchange water can provide contamination to the heat exchange water. Such an unnoticed, continuous addition of water hardness to the recirculating water system may overwhelm the deionizing unit, and cause deposition of solutes in the xenon bulb. This can force termination of operation of the unit and costly repairs.

By this invention, a lamp cooling system is provided which is not dependent upon a cooling water source. Thus, the system of this invention is much more versatile, being useable in many locations where there is no ready source of water. Also, the unit may be portable for moving around between a variety of locations, without the need for connection with a cooling water source. Likewise, the problem of mineral deposits which may enter the recirculating water system through the cooling water can be eliminated, and no drain line is required, in preferred embodiments. The unit of this invention can, in preferred embodiments, be dependent only on one utility, namely electricity, so that a failure of or the absence of a water supply does not limit its use.

Additionally, the lamp cooling system of this invention can serve, where desired, as a source of more useable heat than a typical water cooled system. In cold weather, the unit may serve not only as a xenon bulb cooling system, but also as a room heating system in the same area, or at a location remote from the xenon bulb, to defray other heating costs.

DESCRIPTION OF THE INVENTION

By this invention, a lamp cooling system is provided which comprises a liquid-cooled lamp having passages for flow of fluid coolant therethrough, including a cool fluid inlet and a heated fluid outlet. A flow circuit conduit extends between the outlet and inlet. Liquid/air heat exchange means are positioned in the flow circuit conduit to cool liquid flowing in the flow circuit by heat exchange with air. Also, liquid pump means are provided for the flow circuit conduit.

The flow circuit conduit also preferably includes a liquid reservoir as part of the flow circuit conduit. If desired, a flowing water heat exchange means may be placed in the reservoir, to provide liquid/liquid heat exchange cooling to liquid in the flow circuit conduit, in addition to the liquid/air heat exchange means. Thus, the apparatus of this invention may be versatile, to take advantage of liquid/liquid heat exchange when an abundant supply of water is present, but it may also operate independently of any water source, making use exclusively of the liquid/air heat exchange means.

The liquid-cooled lamp may be a xenon-type "burner" lamp having a high power output of about 2800 or more watts. Also, deionizing means may be positioned in the flow circuit conduit to deionize liquid flowing therein, to prevent deposition of water hardness or other impurities ,in the xenon lamp resulting in a reduction of radiation output.

Preferably, the liquid/air heat exchange means may define stainless steel liquid flow channels which extend across an air stream provided by the heat exchange means, to facilitate the exchange of heat from liquid passing therethrough to the air. To improve the efficiency of such heat exchange, the stainless steel liquid flow channels may be connected to heat-releasing fins which are spaced from the liquid flow and are in contact with the air flow. The fins typically are carried on the outside of stainless steel tubing that carries the liquid for cooling. The fins are preferably made of a metal having greater heat-conductivity than stainless steel, for example copper or an alloy thereof. Liquid/air heat exchange units made in this way are commercially available, for example from Lytron Incorporated of Woburn, Massachusetts.

Thus, a lamp cooling system is provided which can operate independently of a flow of cooling water, to permit its operation when severe water restriction laws are in force, or in undeveloped areas where no good source of cooling water is available. As previously stated, in cold weather, the cooling system may also serve as an auxiliary heater for a building or the like, while in hot weather the unit may be quickly and easily modified to release its heat to the outside air.

If desired, an auxiliary water/water heat exchange unit may also be provided, for further advantageous use of the apparatus, for either ultra high capacity removal of heat from xenon lamps, with both heat exchange units operating simultaneously, or when cold cooling water is readily and inexpensively available.

DESCRIPTION OF DRAWINGS

In the drawings, FIG. 1 is a schematic view of the lamp cooling system of this invention;

FIG. 2 is a detailed, fragmentary view of the interior of the liquid/air heat exchange means, showing a serpentine water-carrying conduit at the location where liquid/air heat exchange takes place, and showing how the conduit carries heat releasing fins; and FIG. 3 is an enlarged sectional view taken along line 3—3 of FIG. 2.

DESCRIPTION OF SPECIFIC EMBODIMENTS

Referring to the drawings, a xenon burner lamp 10 is shown, having a cool fluid inlet 12 and a heated fluid outlet 14 for the application of cooling liquid through flow circuit conduit 16, which may be made of conventional stainless steel tubing and the other components as described below.

Xenon burner lamps are commercially available and of known design. They operate to emit light of high intensity, including ultra violet radiation, and, as described above, generally require continuous liquid cooling in order to avoid damage during operation.

As shown in FIG. 1, heated cooling liquid carries heat from xenon burner 10 via conduit 18, which extends to a liquid/air heat exchanger member 20. Heat exchanger member 20 carries one or more fans to provide an air stream over a serpentine section 24 of conduit 18, for heat exchange between the hot water or other liquid flowing in conduit 24 and the flowing stream of air provided by fans 22. To increase the heat exchange efficiency, the exterior of tubing 24 within heat exchanger 20 carries one or more (specifically an opposed pair is shown) copper fins 26. This improves the heat exchange capability of the serpentine tubing 24 within liquid/air heat exchanger 20. It is generally preferred to use stainless steel tubing, for serpentine tubing 24 because a metal of higher conductivity such as copper is more likely to release copper ions into the liquid which must then be removed in order to prevent deposition in the xenon burner lamp 10. Thus, preferably, stainless steel tubing 24 carries copper fins 26.

Liquid which has completed its transit through heat exchanger 20 then passes through conduit section 28, to spill into liquid reservoir 30. An optional second heat exchange coil 32 is shown positioned in liquid reservoir 30. This unit is not necessary to the operation of the cooling system of this invention, but may in certain circumstances be desirable. Cooling coil 32 is conventionally equipped with end attachments for a connection with a source of pressurized cooling water, so that additional water/water heat exchange may take place in the reservoir 30 between the circulating liquid therein and water within coiled conduit 32. End 33 of conduit 32 may communicate with the pressurized water, while end 34 typically communicates with a drain. Alternatively, cooling coil 32 may be absent.

A thermostat 36 may be positioned to monitor the temperature of the water in reservoir 30. The thermostat 36 is connected by electric line 38 to control unit 40 for liquid/air heat exchanger 20. Thus, heat exchanger 20 will operate to cause cooling of the circulating liquid in a manner responsive to the temperature of liquid in reservoir 30. If desired, the same thermostat 36, or another one, may be utilized for automatic control of the flow of cooling water which passes through second heat exchange coil 32.

Reservoir 30 is generally desirable, whether or not second heat exchange coil 32 is present, to serve as a buffer and to provide a supply of cooling water in the event of small losses of such water during the circulation process.

From reservoir 30, water is drawn through conduit section 42, and through pump 44, to deionizing unit 46, which may be of conventional, commercially available design. From there, the deionized water passes through conduit section 48 of flow circuit conduit 16 into the flow inlet 12 of xenon lamp 10, picking up heat, and then being expelled through flow outlet 14 into conduit section 18 for continuing circulation and cooling.

Thus, a versatile lamp cooling system is provided, being capable of efficient operation independently of an external water source, yet which is also capable, if desired, of operating with cooling water. The cooling system may be used to provide a source of heating of a room or the like through the heat output into the air by the liquid/air heat exchanger 20 in colder weather. However, in warmer weather, heat exchanger 20 may be placed out-of-doors by a simple and easy extension of conduit sections 50, 52 for disposal of the heat. If desired, the heating with heat exchanger 20 may take place at a relatively remote location from the location of the xenon lamp 10, since conduit sections 50, 52 may be lengthened to permit heat exchanger 20 to be placed in another room or another building.

The above has been offered for illustrative purposes only, and is not intended to limit the scope of the invention of this application, which is as defined in the claims below.

That which is claimed is:

1. A lamp cooling system, which comprises, in combination:

a liquid-cooled lamp having passage means for flow of liquid coolant therethrough, including a cool fluid inlet and a heated fluid outlet; a flow circuit conduit extending between the outlet and inlet; liquid/air heat exchange means positioned in said flow circuit conduit to cool liquid flowing therein by heat exchange with air; deionizing means positioned in said flow circuit conduit to deionize liquid flowing therein; and liquid pump means for said flow circuit conduit to circulate cooling liquid therethrough.

2. The lamp cooling system of claim 1 which includes a liquid reservoir as part of said flow circuit conduit, and flowing water heat exchange means in said reservoir to provide liquid/liquid heat exchange cooling to liquid circulating in said flow circuit conduit.

3. The lamp cooling system of claim 1 in which said liquid-cooled lamp is a xenon-type "burner" lamp.

4. The lamp cooling system of claim 1 in which said liquid/air heat exchange means defines stainless steel liquid flow channel means connected to heat releasing fins which are in contact with air flow, and spaced from liquid flow, said heat releasing fins being made of a metal having greater heat-conductivity than stainless steel.

5. The lamp cooling system of claim 1 which includes a liquid reservoir as part of said flow circuit which is free of any flowing water heat exchange means.

6. The lamp cooling system of claim 1 in which said liquid/air heat exchange means defines convoluted liquid flow channel means, individual convoluted flow channels of which extend repeatedly through a plurality of aperatures in at least one heat releasing fin positioned in heat exchange relation therewith.

7. The lamp cooling system of claim 6 in which said convoluted liquid flow channel means are made of stainless steel and said heat releasing fins are made of a metal having greater heat conductivity than stainless steel.

8. The lamp cooling system, which comprises, in combination:

a liquid-cooled lamp having passage means for flow of liquid coolant therethrough, including a cool fluid inlet and a heated fluid outlet; a flow circuit conduit extending between the outlet and inlet; liquid/air heat exchange means positioned in said flow circuit conduit to cool liquid flowing in said flow circuit conduit by heat exchange with air, in which said liquid/air heat exchange means define stainless steel liquid flow channel means connected to heat releasing fins which are in contact with air flow and spaced from liquid flow, said heat releasing fins being made of a metal having greater heat-conductivity than stainless steel; said cooling system also including a liquid reservoir as part of said flow circuit conduit, and flowing water heat exchange means in said reservoir to provide liquid/-liquid heat exchange cooling to liquid flowing in said flow circuit conduit; deionizing means positioned in said flow circuit conduit to deionize liquid flowing therein; and liquid pump means for said flow circuit conduit to circulate cooling liquid therethrough.

9. The lamp cooling system of claim 8 in which said liquid-cooled lamp is a xenon-type "burner" lamp.

10. The lamp cooling system of claim 8 in which said liquid/air heat exchange means defines convoluted liquid flow channel means, individual convoluted flow channels of which extend repeatedly through a plurality of aperatures in at least one heat releasing fin in heat exchange relation therewith.

11. A lamp cooling system, which comprises, in combination:

a liquid-cooled lamp having passage means for flow of liquid coolant therethrough, including a cool fluid inlet and a heated fluid outlet; a flow circuit conduit extending between the outlet and inlet; liquid/air heat exchange means positioned in said flow circuit conduit to cool liquid flowing in said flow circuit conduit by heat exchange with air, in which said liquid/air heat exchange means defines stainless steel liquid flow channel means connected to heat releasing fins which are in contact with air flow and spaced from liquid flow, said heat releasing fins being made of a metal having greater heat-conductivity than stainless steel; deionizing means positioned in said flow circuit conduit to deionize liquid flowing therein; and liquid pump means for said flow circuit conduit to circulate cooling liquid therethrough.

12. The lamp cooling system of claim 11 in which said liquid-cooled lamp is a xenon-type "burner" lamp.

13. The lamp cooling system of claim 11 in which said liquid/air heat exchange means defines convoluted liquid flow channel means, individual convoluted flow channels of which extend repeatedly through a plurality of apertures in at least one heat releasing fin in heat exchange relation therewith.

* * * * *